US005927720A

United States Patent [19]

Zinsmeyer et al.

[11] Patent Number: 5,927,720

[45] Date of Patent: Jul. 27, 1999

[54] TWO-PIECE LABYRINTH SEAL FOR A CENTRIFUGAL COMPRESSOR BALANCE PISTON

[75] Inventors: Thomas M. Zinsmeyer, Pennellville; Paul W. Sweet, Clay, both of N.Y.

[73] Assignee: Carrier Corporation, Syracuse, N.Y.

[21] Appl. No.: 08/963,380

[22] Filed: Nov. 3, 1997

[51] Int. Cl.[6] ..... F16J 15/447

[52] U.S. Cl. ..... 277/303; 277/412; 277/421; 277/411; 415/105; 415/111; 417/423.11

[58] Field of Search ..... 277/303, 409, 277/411, 412, 421; 415/104, 105, 111; 417/365, 372, 423.11

[56] References Cited

U.S. PATENT DOCUMENTS 1,773,067 8/1930 Planck ..... 277/412
3,902,404 9/1975 Breit ..... 92/86
4,884,942 12/1989 Pennink ..... 415/105
4,997,340 3/1991 Zinsmeyer et al. ..... 415/105
5,074,567 12/1991 Orlowski .
5,316,317 5/1994 Fedorovich et al. .

*Primary Examiner*—Anthony Knight
*Assistant Examiner*—Alison K. Pickard

[57] ABSTRACT

In order to accommodate a labyrinth seal whose diameter is too large to form a gas passage using conventional techniques, the labyrinth seal is made in two parts. A first part is an inner ring whose outer diameter is sufficiently small so as to permit the forming of a passage therein with conventional techniques. The second part is an outer ring which can then be fastened to the inner ring so as to then extend, in combination, to the radial extent necessary to complete the sealing engagement with an adjacent element. The outer and inner rings are preferably interconnected by way of an interference fit.

7 Claims, 2 Drawing Sheets

TWO-PIECE LABYRINTH SEAL FOR A CENTRIFUGAL COMPRESSOR BALANCE PISTON

BACKGROUND OF THE INVENTION

This invention relates generally to centrifugal compressors and, more particularly, to a method and apparatus for providing a relatively large diameter labyrinth seal between a transmission chamber and a low pressure area in a balance piston adjacent the impeller.

In order to counteract the aerodynamic thrust that is developed by the impeller of a centrifugal compressor, it is well known to employ a balance piston consisting of a low pressure cavity behind the impeller wheel. Because of the tendency for lubricating oil to leak from the transmission into this low pressure area, it is also common practice to install a labyrinth seal between the balance piston and the transmission. U.S. Pat. No. 4,997,340, assigned to the assignee of the present invention, describes such a labyrinth seal and a particular manner in which the seal is pressurized in order to obtain optimal performance in an economical manner. The full text of that patent is hereby incorporated, by reference, into this application.

The passage that is formed in the labyrinth seal of U.S. Pat. No. 4,997,340 is formed by first drilling a radially extending passage from the outer surface to the radially inner surface of the labyrinth seal, and then drilling another passage from the rear face of the seal to interconnect the radially extending passage. This method has been found satisfactory for relatively small and medium sized labyrinth seals.

The need has now arisen to install a larger diameter (i.e. in the range of 11 to 12 inch diameter) labyrinth seal in a centrifugal compressor. The normal method as described hereinabove can therefore not be used because conventional drilling techniques do not permit the hole to be positioned accurately enough to consistently intersect with the labyrinth teeth at the desired location. That is, because of the necessarily small thickness of the seal, the passageway must be of a small diameter. When using a small diameter drill bit, it tends to bend and wander from the intended path unless the length is kept relatively short.

It is therefore an object of the present invention to provide an improved labyrinth seal arrangement for a centrifugal compressor.

Another object of the present invention is the provision in a centrifugal compressor for a relatively large diameter labyrinth seal.

Yet another object of the present invention is the provision in a centrifugal compressor for effectively and economically forming the radially extending passage in a relatively large diameter labyrinth seal.

These objects and other features and advantages become more readily apparent upon reference to the following description when taken in conjunction with the appended drawings.

SUMMARY OF THE INVENTION

Briefly, in accordance with one aspect of the invention, a labyrinth seal is formed in two parts, and then the two parts are assembled together for installation into a centrifugal compressor.

First, an inner ring is formed with an inner diameter having labyrinth teeth for receiving the shaft, and an outer diameter which is sufficiently small so as to permit the forming of a passage in a conventional manner. A second ring is then formed having an inner diameter substantially equal to the outer diameter of the inner ring, and having a radially outer portion with a flange containing labyrinth teeth for engaging a portion of the rear surface of the impeller in a sealing manner. The inner and outer rings are then assembled into a integral labyrinth seal for installation into the compressor.

By another aspect of the invention, the outer ring is interconnected to the inner ring by way of an interference fit. This is accomplished by heating the outer ring, installing the inner ring therein, and allowing the outer ring to cool and shrink fit over the inner ring.

In the drawings as hereinafter described, a preferred embodiment is depicted; however, various other modifications and alternate constructions can be made thereto without departing from the true spirit and scope of the invention.

DESCRIPTION OF THE PREFERRED EMBODIMENT

Figure 1:
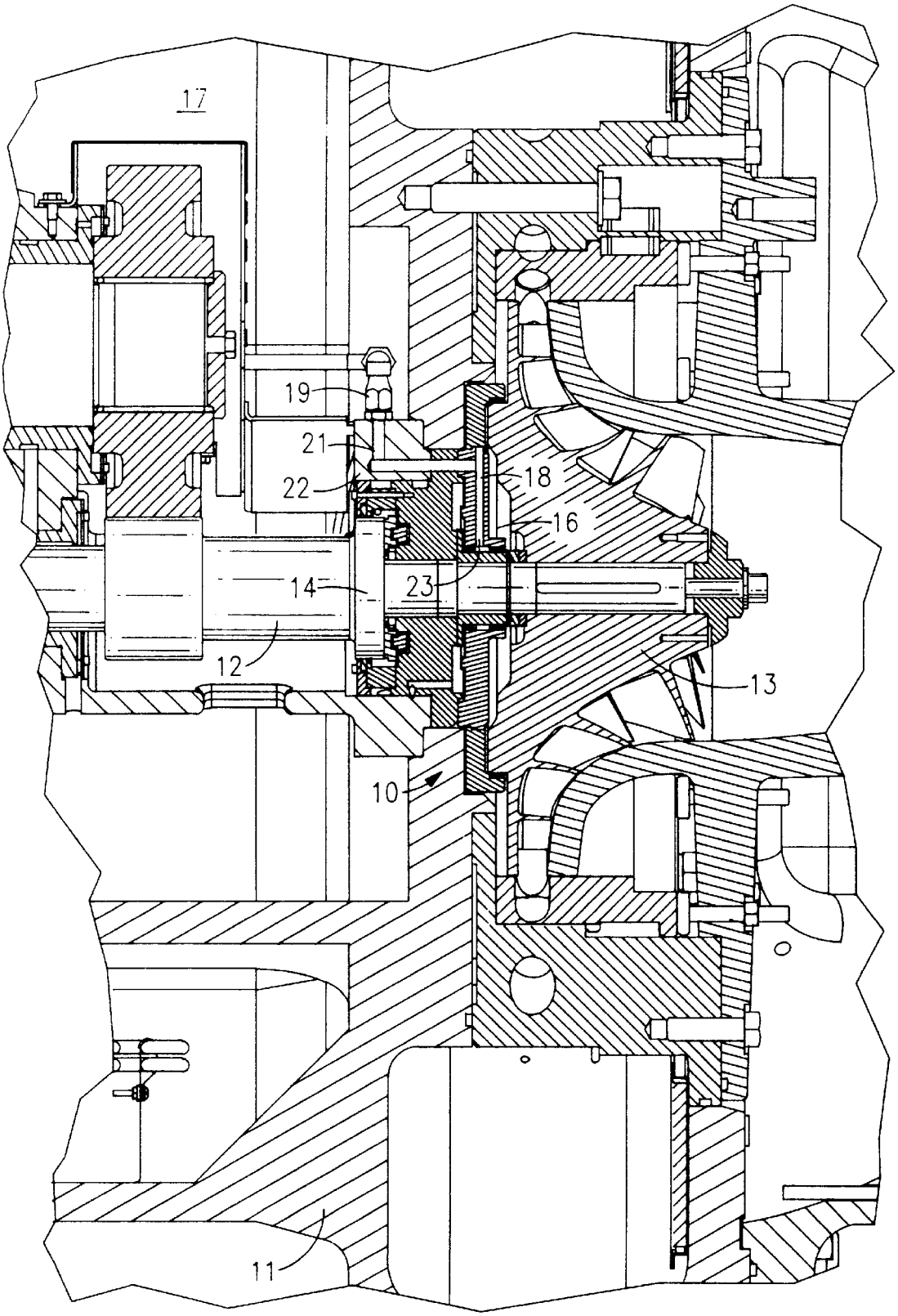
FIG. 1 is a partial longitudinal cross sectional view of a centrifugal compressor having the labyrinth seal of the present invention incorporated therein.

Referring now to FIG. 1, the invention is shown generally at 10 as installed in a centrifugal compressor system 11 having a high speed shaft 12 driving an impeller 13 in a conventional manner. The high speed shaft 12 is supported by a journal bearing 14 and another journal bearing to the left thereof (not shown).

In order to provide a counteraction to the aerodynamic thrust that is developed by the impeller 13, a "balance piston" is provided by way of a low pressure cavity 16 behind the impeller wheel 13. A passage (not shown) is provided in the impeller 13 for the purpose of maintaining the pressure in the cavity 16 at the same low pressure as the compressor suction pressure. Since the pressure in the transmission casing (shown generally by the numeral 17) is higher than in the cavity 16, and especially at part load operation, a labyrinth seal 18 is provided between the bearing 14 and the impeller 13 to seal that area against the flow of oil from the transmission into the balance piston cavity 16. This concept is well known as is the further concept of pressurizing the labyrinth seal by exerting a high pressure gas thereon. As described in U.S. Pat. No. 4,997,340, the labyrinth seal 18 is preferably pressurized at the motor casing pressure, which is slightly above the pressure in the transmission casing 17. The pressurizing vapor therefore passes through a line 19, through a passage 21 formed in the flange member 22 and the journal bearing 14, and finally through the passage 23 formed in the labyrinth seal 18.

Figure 2:
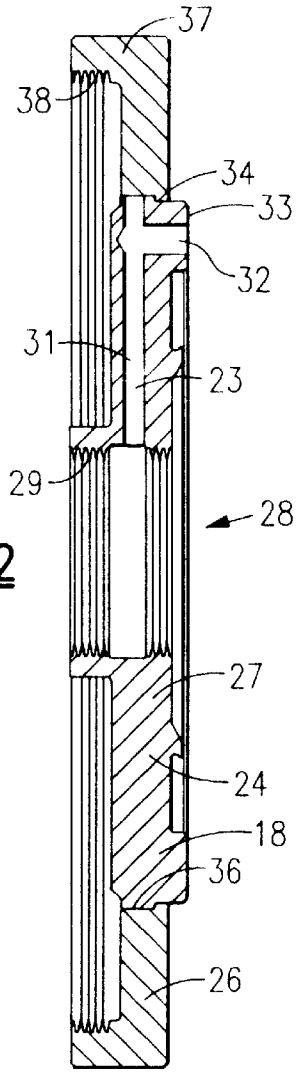
FIG. 2 is a longitudinal cross sectional view of the labyrinth seal portion of the present invention.
Figure 3:
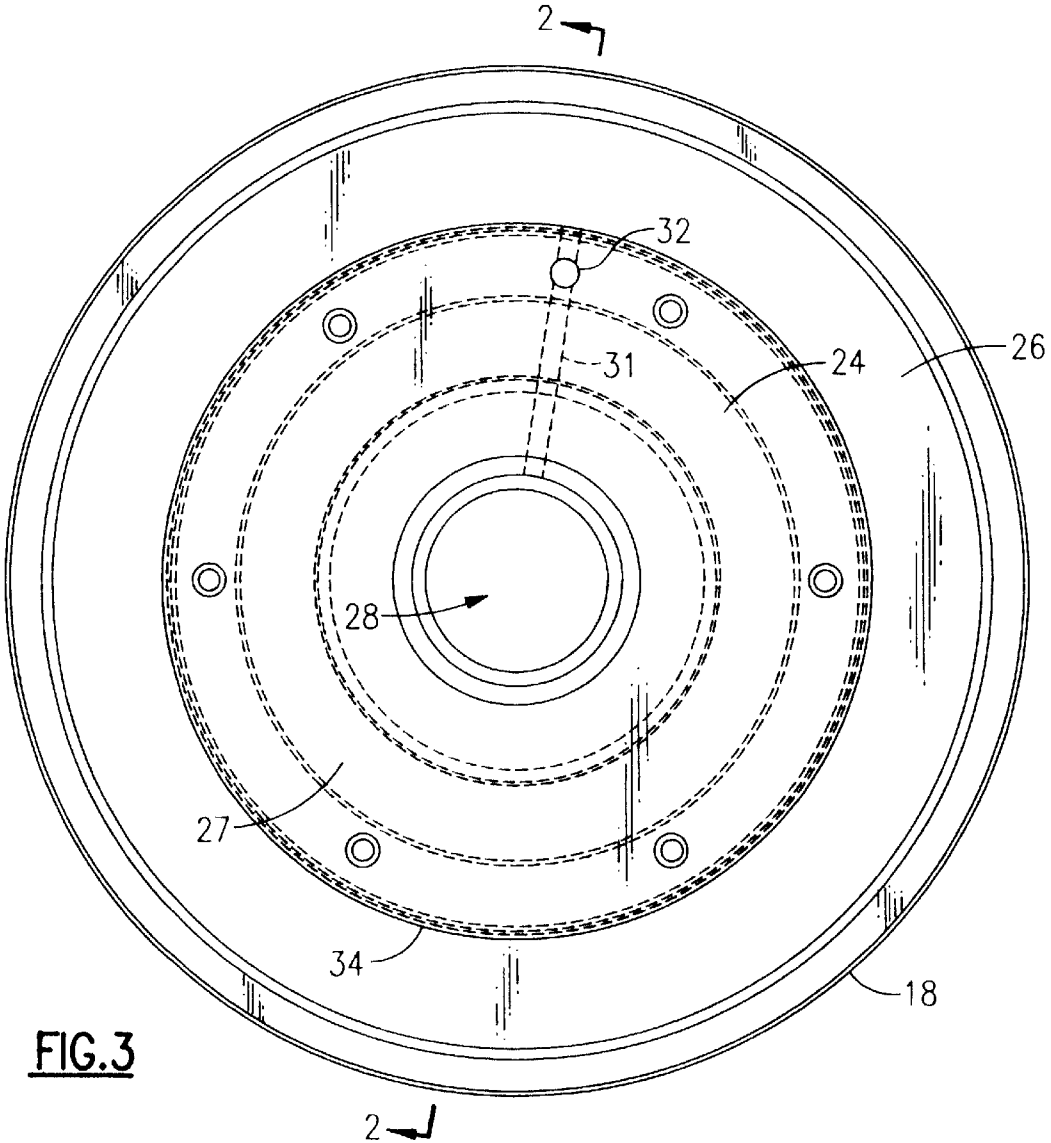
FIG. 3 is a rear view thereof.

The labyrinth seal 18 is shown in greater detail in FIGS. 2 and 3 and includes an inner ring 24 and an outer ring 26. Both rings are preferably made of an aluminum material but may be composed of any other suitable material.

The inner ring comprises an annular body 27 with an axial opening 28 having a plurality of labyrinth teeth 29 formed therein for sealingly receiving the drive shaft therethrough. The passage 23 is formed of the combination of the radially extending passage 31 and an axially extending passage 32.

These passages are drilled in a conventional manner, with the axial passage 32 extending from a rear face 33 to a point that intersects with the radial passage 31. The radial passage 31 extends from an outer annulus 34 to the axial opening 28.

In fabrication of the inner ring, the axial opening 28 is first formed by a conventional drilling or boring process. The radial 31 and axial 32 passages are then drilled in a conventional manner. Finally, the labyrinth teeth 29 are formed by a standard machining process.

The outer ring 26 has an annular inner surface 36 of substantially the same diameter as that of the outer annulus 34 of the inner ring 24. On its radially outer portion, an axially extending flange 37 projects outwardly and has labyrinth teeth 38 formed on the radially inner surface thereof for engaging a surface on the impeller as shown in FIG. 1. The outer ring is fabricated first by machining the proper diameter in the annular inner surface 36 and then machining the labyrinth teeth thereon.

After the inner and outer rings 24 and 26 have been formed, they are then assembled by first heating the outer ring 26, inserting the inner ring therein and then allowing the outer ring to cool to create an interference fit between the outer annulus 34 of the inner ring 24 and the annular inner surface 36 of the outer ring 26. As will be seen in FIG. 2, when the two rings are assembled, the outer ring acts to close the radially outer end of the radial passage 31, thereby providing for the continuous flow of fluid first through the axial passage 32 and then radially inwardly through the radial passage 31 to the labyrinth teeth 29.

While the present invention has been disclosed with particular reference to a preferred embodiment, the concepts of this invention are readily adaptable to other embodiments, and those skilled in the art may vary the structure thereof without departing from the true spirit and scope of the invention.

What is claimed is:

1. In a centrifugal compressor of the type having a drive shaft, an impeller, a bearing, a transmission chamber and a balance piston to counteract the thrust load of the impeller, a labyrinth seal interposed between the balance piston and the transmission chamber, wherein the labyrinth seal comprises an inner ring and an outer ring, said inner ring comprising:

an axial opening with radially inwardly extending teeth for sealingly receiving said drive shaft therein, a rear face for engaging a surface of the bearing disposed adjacent thereto, a passage formed between said rear face and said axial opening for providing fluid communication therebetween for the purpose of pressurizing the labyrinth seal, and an outer cylindrical surface located radially outwardly from said passage; and said outer ring comprising: an axial opening for receivingly engaging said outer cylindrical surface of said inner ring, an axially extending flange integrally connected near a radially outer portion of said outer ring, and said flange having radially extending teeth for sealingly engaging a surface on a rear side of said impeller.

2. A labyrinth seal as set forth in claim 1 wherein said inner ring and outer ring are interconnected by way of an interference fit.

3. A labyrinth seal as set forth in claim 1 wherein said passage comprises a radially extending portion and an axially extending portion.

4. A labyrinth seal as set forth in claim 1 wherein said radially extending teeth for sealingly engaging a surface on the rear side of an impeller are extending radially inwardly.

5. A method of manufacturing a labyrinth seal for axial placement around an axial shaft and behind an impeller of a centrifugal compressor, comprising the steps of:

forming an inner ring with an axial opening having radially inwardly extending teeth for sealingly receiving a rotatable shaft therein, said inner ring having an outer annular surface and rear face for engaging a surface of a bearing to be disposed adjacent thereto;

forming a gas passage between said rear face and said axial opening, said passage providing for the flow of a gas to said teeth in said axial opening;

forming an outer ring with an axial opening for receiving said inner ring, and a radially outer portion with an axially extending flange with radially extending teeth for sealingly engaging a surface on the rear side of the impeller; and securing said outer annular surface of said inner ring into said outer ring axial opening.

6. The method as set forth in claim 5 wherein said securing step is accomplished by heating the outer ring, inserting the inner ring therein, and allowing the outer ring to cool to thereby create a shrink fit between the two rings.

7. The method as set forth in claim 5 wherein said teeth formed on said outer ring are formed so as to extend radially inwardly.

* * * * *